United States Patent [19]

Houseman

[11] 4,439,299

[45] Mar. 27, 1984

[54] ELECTROLYTIC METAL RECLAMATION DEVICE

[75] Inventor: Kenneth R. Houseman, Westlake, Ohio

[73] Assignee: General Dental, Inc., St. Louis, Mo.

[21] Appl. No.: 445,965

[22] Filed: Dec. 1, 1982

[51] Int. Cl.[3] ..... C25C 1/20; C25C 7/00; C25B 11/10; C25B 11/12

[52] U.S. Cl. ..... 204/271; 204/290 R; 204/290 F; 204/294; 204/292; 204/109; 204/297 R

[58] Field of Search ..... 204/271, 109, 292, 290 F, 204/290 R, 294, 242, 297 R

[56] References Cited

U.S. PATENT DOCUMENTS

| | | | |
|---|---|---|---|
| 2,349,083 | 5/1944 | Farr, Jr. | 204/242 X |
| 2,505,228 | 4/1950 | Chase | 204/271 |
| 2,616,845 | 11/1952 | Kreml | 204/242 |
| 4,175,026 | 11/1979 | Houseman | 204/290 R X |
| 4,316,787 | 2/1982 | Themy | 204/271 X |

*Primary Examiner*—Donald R. Valentine

*Attorney, Agent, or Firm*—Pearne, Gordon, Sessions, McCoy, Granger & Tilberry

[57] ABSTRACT

A device for recovering metal from an aqueous bath generating metal ions, by means of an electrolytic process. The device includes a source of direct current and a non-conductive base plate adapted to be immersed in the aqueous bath. One face of the base plate has a conductive anodic surface layer thereon operatively connected to the direct current source for charging the anodic surface positively. The other face of the base plate has a conductive cathodic surface layer thereon also operatively connected to the direct current source for charging the cathodic surface negatively so that metal from the metal ion bath is plated onto the cathodic surface.

5 Claims, 6 Drawing Figures

ELECTROLYTIC METAL RECLAMATION DEVICE

BACKGROUND OF THE INVENTION

This invention relates to the recovery of metal in aqueous solutions, and more particularly to an electrolytic device for recovering metal in an aqueous bath that is generating metal ions. The metal recovery process proceeds simultaneously with the process that generates the metal ions. The device of the invention is particularly useful in connection with the recovery of silver from fixing solutions used in photographic or X-ray film processing wherein the device is operable to recover silver simultaneously with the fixing process that produces silver ions.

Methods for the electrolytic recovery of metal generally involve the immersion of a pair of electrodes within the aqueous electrolytic solution containing metal ions. A voltage of sufficient magnitude is impressed across the electrodes to effect migration of the metal ions to the cathode surface, whereupon the metal ions become deionized and deposit a continuous film or coherent plate on the cathode surface. Thereafter the metal plate can be removed.

For example U.S. Pat. No. 3,953,313 discloses an electrolytic cell containing a plurality of alternate anode and cathode plates spaced laterally and having a sheet of mesh material on each electrode thus providing a plurality of holes therein. Alternatively, each electrolytic cell has a housing provided with an inlet pipe and an outlet pipe adapted to transfer the electrolytic solution from a storage container to the electrolytic cell. The electrolytic solution is processed in the electrolytic cell.

Other methods of metal recovery are shown in U.S. Pat. Nos. 3,663,416 and 4,174,026 wherein a helical or spiral electrode element is placed in a container wherein fluid passageways interconnect the container with a storage or metal ion producing bath. The prior art processes, however, require separate self-contained electrolytic cells to recover the metal in a separate process from that which produces the metal ions.

The device of the present invention, however, is effective to recover metal from an aqueous bath that generates metal ions simultaneously and in the same unit in which the metal ion generating process is proceeding. As indicated above, the device is particularly useful for recovering silver from the fixing bath utilized in a photographic or X-ray fixing process that results in the generation of silver ions.

SUMMARY OF THE INVENTION

It is among the objects of the present invention to recover metal from an aqueous bath simultaneously with the process that generates metal ions in the bath.

Another object is to simplify the recovery of silver ions from a fixing bath for a photographic or X-ray developing process.

These and other objects and advantages are achieved with the novel metal recovery device of the invention which is adapted to be immersed in an aqueous bath undergoing simultaneously a process resulting in the generation of metal ions. The device includes a direct current source and a non-conductive base plate with spacers thereon to position the faces of the plate away from the surfaces of the receptacle that contains the aqueous bath. One face of the base plate has a conductive anodic surface layer thereon operatively connected to the direct current source for charging the anodic surface positively. The other face of the base plate has a conductive cathodic surface layer thereon also operatively connected to the direct current source for charging the cathodic surface negatively so that metal from the metal ion bath is plated onto the cathodic surface.

DESCRIPTION OF THE PREFERRED EMBODIMENT

Figure 1:
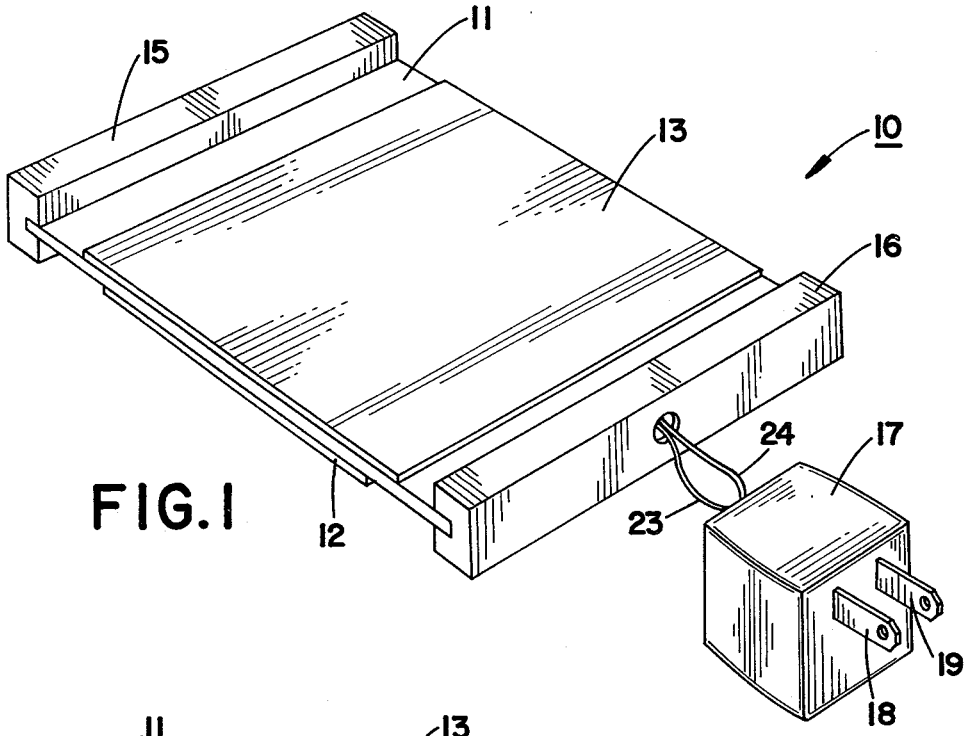
FIG. 1 is a perspective view of the metal recovery device of the invention.
Figure 2:
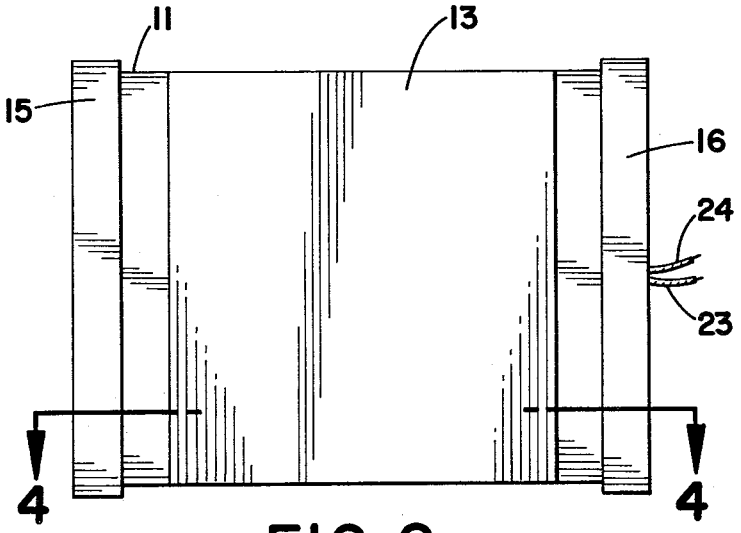
FIG. 2 is a plan view of the metal recovery device shown in FIG. 1.
Figure 3:
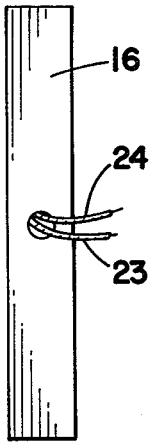
FIG. 3 is a side elevation of the metal recovery device of FIGS. 1 and 2.
Figure 4:
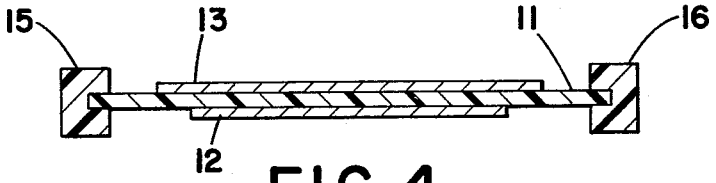
FIG. 4 is a sectional view taken on the line 4—4 of FIG. 2.

Referring more particularly to the drawings, there is shown a metal recovery device 10 adapted to be immersed in an aqueous bath generating metal ions such as the fixing bath used in a process for developing photographic or X-ray film. The device includes a base plate 11 formed of a non-conductive material such as a natural or synthetic plastic material such as polyethylene, polyethylene terephthalate, polypropolyene, polystyrene, polyvinylchloride, phenol formaldehyde resin, polyurethane, polyamide, polyester, epoxy resins as well as natural or synthetic rubbers or elastomers such as butadiene styrene, vinyl and acrylic copolymers and polychloroprene or other rigid or semi-rigid plastic structural material.

One face of the base plate 11 has a conductive surface layer applied thereto to form an anodic surface 12 and the other face of the base plate 11 has another surface layer of conductive material applied thereto to form a cathodic surface.

The conductive anodic surface 12 is a non-sacrificing or non-oxidizing material and advantageously comprises plastic containing conductive material, such as carbon, platinized titanium or tantalum. The conductive cathodic layer 13 can also be a flexible plastic containing conductive material such as silver, graphite or carbon as suggested in U.S. Pat. Nos. 3,953,313, and 4,175,026, or carbon black as suggested in U.S. Pat. No. 4,009,093.

Located at opposite ends of the base plate 11 are end caps 15 and 16 which serve to support the base plate 11 and the anodic and cathodic surfaces 12 and 13 thereon in the container for the aqueous bath in such a way that surfaces 12 and 13 are spaced from any wall, floor or any other structure of the container for the bath.

Figure 6:
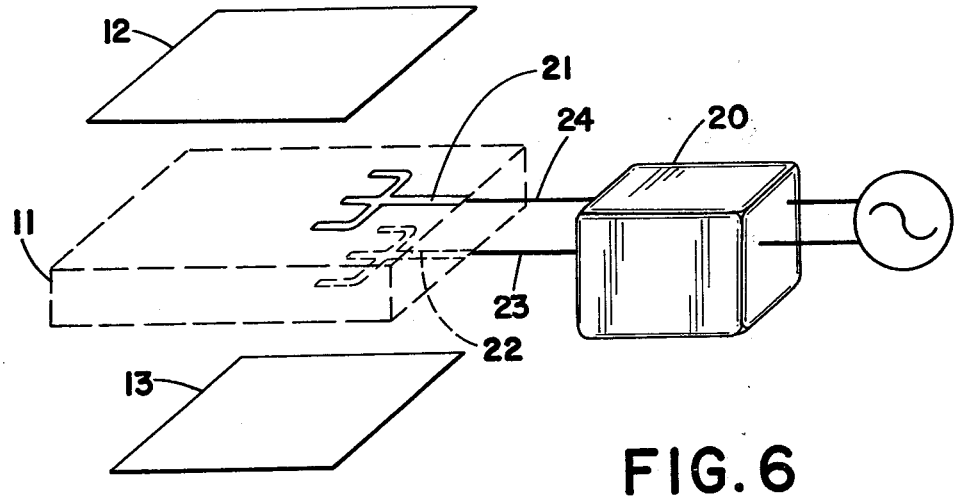
FIG. 6 is primarily an electrical schematic showing the electrical connection of the various circuit elements of the device.

The device 10 is adapted to be connected to a wall receptacle for a standard 110 volt electrical power line by means of a plug 17 with conventional prongs 18 and 19. The plug also serves as the housing for a rectifier 20 (FIG. 6).

The positive terminal of the rectifier 20 is connected by a lead 23 to a positively charged electrical pole element 21 formed in the respective face of the base plate 11 and in contact with the anodic surface 12 and another lead 24 serves to connect the negative terminal of the rectifier to a negatively charged electrical pole element 22 formed in the opposite face of the base plate 11 and in contact with the cathodic surface 13.

Figure 5:
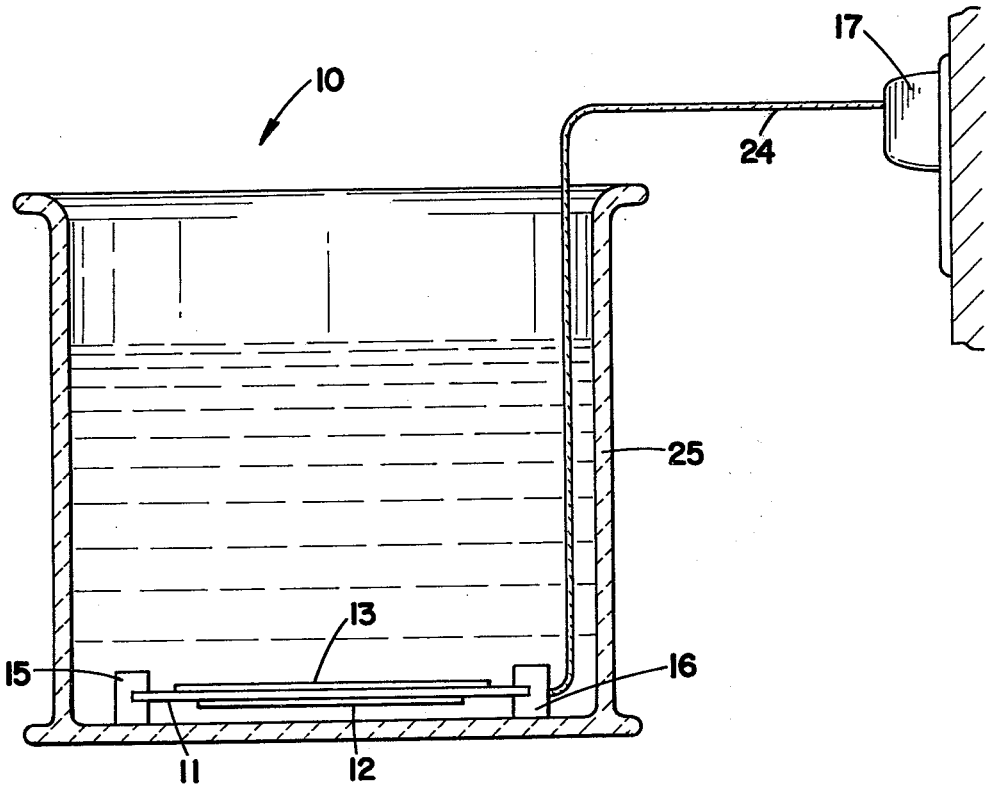
FIG. 5 is a sectional view showing the metal recovery device in use in an aqueous electrolytic solution containing metal ions.

FIG. 5 shows the metal recovery device 10 positioned in an aqueous bath located in a container 25. It will be noted that the end caps 15 and 16 rest against the bottom of the container so that the anodic and cathodic surfaces 12 and 13 are well spaced from any wall or other structural part of the container.

In operation, such as in recovering silver from a fixing solution for photographic or X-ray film, the device is placed in the aqueous bath in which silver ions are being produced and the plug 17 is inserted into a convenient wall outlet. A direct current is impressed upon the anode surface 12 and the cathodic surface 13 so that metal ions migrate toward the cathodic surface 13 and are plated thereon. After a buildup of plated silver is achieved, the device 10 is removed from the processing bath and plated silver is removed, such as by scrapping or other means. When the plated silver is removed, the device can again be immersed in the fixing bath to continue the silver recovery process. The device is operative to recover silver or other metal without disturbing the chemicals or the primary process generating the metal ions.

While the invention has been shown and described with respect to a specific embodiment thereof, this is intended for the purpose of illustration rather than limitation and other modifications and variations of the specific device herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. In combination, a container for an aqueous bath generating metal ions and a device immersed in said container and positioned flat on the bottom thereof for recovering metal by electrolytic deposition from said aqueous bath, said device comprising:

a direct current source;

a non-conductive flat structural base plate;

a positively charged electrical polar means formed on one face of said base plate and operatively connected to said direct current source;

a negatively charged electrical polar means formed on the other face of said base plate and operatively connected to said direct current source;

a flat planar anodic surface layer comprising a flexible plastic material containing conductive particles formed on said one face of said base plate overlying and contacting said positively charged polar means for charging said anodic surface layer positively;

a flat planar cathodic surface layer comprising a flexible plastic material containing conductive particles formed on said other face of said base plate overlying and contacting said negatively charged polar means for charging said cathodic surface layer negatively;

means for supporting said base plate in said aqueous bath lying flat on the bottom of said container with said anodic and cathodic surface layers exposed in their entirety to said aqueous bath;

whereby to cause metal from said metal-ion-containing aqueous bath to be plated onto said cathodic surface layer.

2. A combination as defined in claim 1, wherein said anodic surface layer comprises a plastic material containing conductive particles from the group consisting of carbon, platinized titanium, and tantalum.

3. A combination as defined in claim 1, wherein said cathode surface layer comprises a flexible plastic material containing conductive particles from the group consisting of silver, graphite, or carbon.

4. A combination as defined in claim 1, wherein said metal ions in said aqueous bath comprise silver ions.

5. A combination as defined in claim 1, wherein said direct current source comprises a rectifier operably connectable to a receptacle for a 110-volt electrical supply circuit.

* * * * *